US007037221B2

(12) United States Patent
Bouffard et al.

(10) Patent No.: US 7,037,221 B2
(45) Date of Patent: May 2, 2006

(54) FRAMELESS PORTABLE SUSPENSION SYSTEM

(76) Inventors: Rafael P. Bouffard, 10 Lake Helix Dr., La Mesa, CA (US) 91941; Barton G. Dunlevy, 9812 Bonnie Vista Dr., La Mesa, CA (US) 91941

( * ) Notice: Subject to any disclaimer, the term of this patent is extended or adjusted under 35 U.S.C. 154(b) by 140 days.

(21) Appl. No.: 10/823,062

(22) Filed: Apr. 13, 2004

(65) Prior Publication Data

US 2005/0227794 A1 Oct. 13, 2005

(51) Int. Cl.
*A63B 61/02* (2006.01)

(52) U.S. Cl. ..... 473/492; 473/478; 248/156; 40/603

(58) Field of Classification Search ..... 473/478, 473/197, 421, 492; 273/400, 394, 395, 396; 296/161; 248/156, 159; D21/799.1; 40/610, 40/603

See application file for complete search history.

(56) References Cited

U.S. PATENT DOCUMENTS 1,557,940 A * 10/1925 La Plant ..... 248/156
1,566,945 A 12/1925 Winkley
1,675,249 A * 6/1928 Carver ..... 473/493
1,701,236 A * 2/1929 Jones ..... 40/603
1,870,798 A * 8/1932 Einson ..... 40/603
2,005,134 A * 6/1935 Emley ..... 40/603
3,001,795 A 9/1961 Johnson, Jr.
3,195,898 A * 7/1965 Respini ..... 473/197
3,856,301 A * 12/1974 Davidson ..... 473/439
4,127,267 A 11/1978 Bay et al.
4,264,070 A 4/1981 Torres
4,700,498 A * 10/1987 Perutz et al. ..... 40/603
5,263,468 A * 11/1993 Powell ..... 126/204
5,342,063 A 8/1994 O'Brien et al.
5,407,211 A 4/1995 Bottiglieri
5,492,430 A * 2/1996 Jones ..... 403/109.5
5,562,288 A 10/1996 Erkebaev
5,690,339 A 11/1997 Chen
5,810,363 A * 9/1998 Saunders et al. ..... 273/407
5,983,545 A * 11/1999 Marco ..... 40/610
6,332,284 B1 * 12/2001 Tafforeau ..... 40/603
2001/0034274 A1 10/2001 Tulipani et al.
2002/0013187 A1 1/2002 Grunfeld
2002/0030324 A1 3/2002 Macaluso
2002/0119842 A1 8/2002 Vermeulen

* cited by examiner

*Primary Examiner*—Eugene Kim
*Assistant Examiner*—M. Chambers
(74) *Attorney, Agent, or Firm*—Stephen C. Beuerle; Procopio, Cory, Hargreaves & Savitch LLP

(57) ABSTRACT

A frameless portable suspension system includes a tensional two-dimensional material having a frameless perimeter, opposite upper corners, and a bottom secured to ground, the tensional two-dimensional material located in a vertical plane perpendicular to the ground; a pair of adjustable spring mechanisms coupled to the upper corners and providing the upper corners in tension in an upward vertical direction and a outward horizontal direction, and wherein the tension in the tensional two-dimensional material is adjustable with the adjustable spring mechanisms while the tensional two-dimensional material is under tension and the tensional two-dimensional material is positionable in a vertical plane perpendicular to the ground upon adjustment of the tension in the tensional two-dimensional material with the adjustable spring mechanism.

16 Claims, 5 Drawing Sheets

FRAMELESS PORTABLE SUSPENSION SYSTEM

FIELD OF THE INVENTION

The present invention is in the field of portable sport rebounders and portable sign suspension assemblies.

BACKGROUND OF THE INVENTION

Sports nets and rebounders have been devised in the past to catch sports balls and/or to rebound sports balls delivered (e.g., thrown, kicked, hit, etc.) at the net/rebounder by a user. These sports nets/rebounders have suffered from a number of drawbacks, one or more of which include: 1) the rebounder does not adequately rebound the sports ball to the user, 2) the sports net/rebounder is difficult and/or time consuming to assembly, 3) the sports net/rebounder is not portable, 4) the sports net/rebounder includes a perimeter frame made of numerous and/or lengthy poles or other supports.

SUMMARY OF THE INVENTION

The frameless portable suspension system of the present invention represents an improvement over sports nets and rebounders of the past, and may be used in other applications, such as, but not limited to, portable sign suspension.

An aspect of the present invention involves a frameless portable suspension system. The frameless portable suspension system includes a tensional two-dimensional material having a frameless perimeter, opposite upper corners, and a bottom secured to ground, the tensional two-dimensional material located in a vertical plane perpendicular to the ground; a pair of adjustable spring mechanisms coupled to the upper corners and providing the upper corners in tension in an upward vertical direction and a outward horizontal direction, and wherein the tension in the tensional two-dimensional material is adjustable with the adjustable spring mechanisms while the tensional two-dimensional material is under tension and the tensional two-dimensional material is positionable in a vertical plane perpendicular to the ground upon adjustment of the tension in the tensional two-dimensional material with the adjustable spring mechanism.

Another aspect of the present invention involves a frameless portable suspension system. The frameless portable suspension system includes a tensional two-dimensional material having a frameless perimeter, opposite upper corners, and a bottom secured to ground, the tensional two-dimensional material located in a vertical plane perpendicular to the ground; a pair of adjustable length resilient poles coupled to the upper corners of the tensional two-dimensional material and including a longitudinal center; a pair of tension connectors including ends connected to the pair of adjustable length resilient poles below the longitudinal center to provide flex in the pair of adjustable length resilient poles and opposite ends secured to the ground.

A further aspect of the present invention involves a frameless portable suspension system. The frameless portable suspension system includes a tensional two-dimensional material having a frameless perimeter, opposite upper corners, and a bottom secured to ground, the tensional two-dimensional material located in a vertical plane perpendicular to the ground; a pair of adjustable length resilient poles including upper ends coupled to the upper corners of the tensional two-dimensional material and lower ends freely pivotal relative to the ground, and wherein the pair of adjustable length resilient poles provide the upper corners in tension in an upward vertical direction and a outward horizontal direction.

Further objects and advantages will be apparent to those skilled in the art after a review of the drawings and the detailed description of the preferred embodiments set forth below.

DETAILED DESCRIPTION OF PREFERRED EMBODIMENTS

Figure 1:
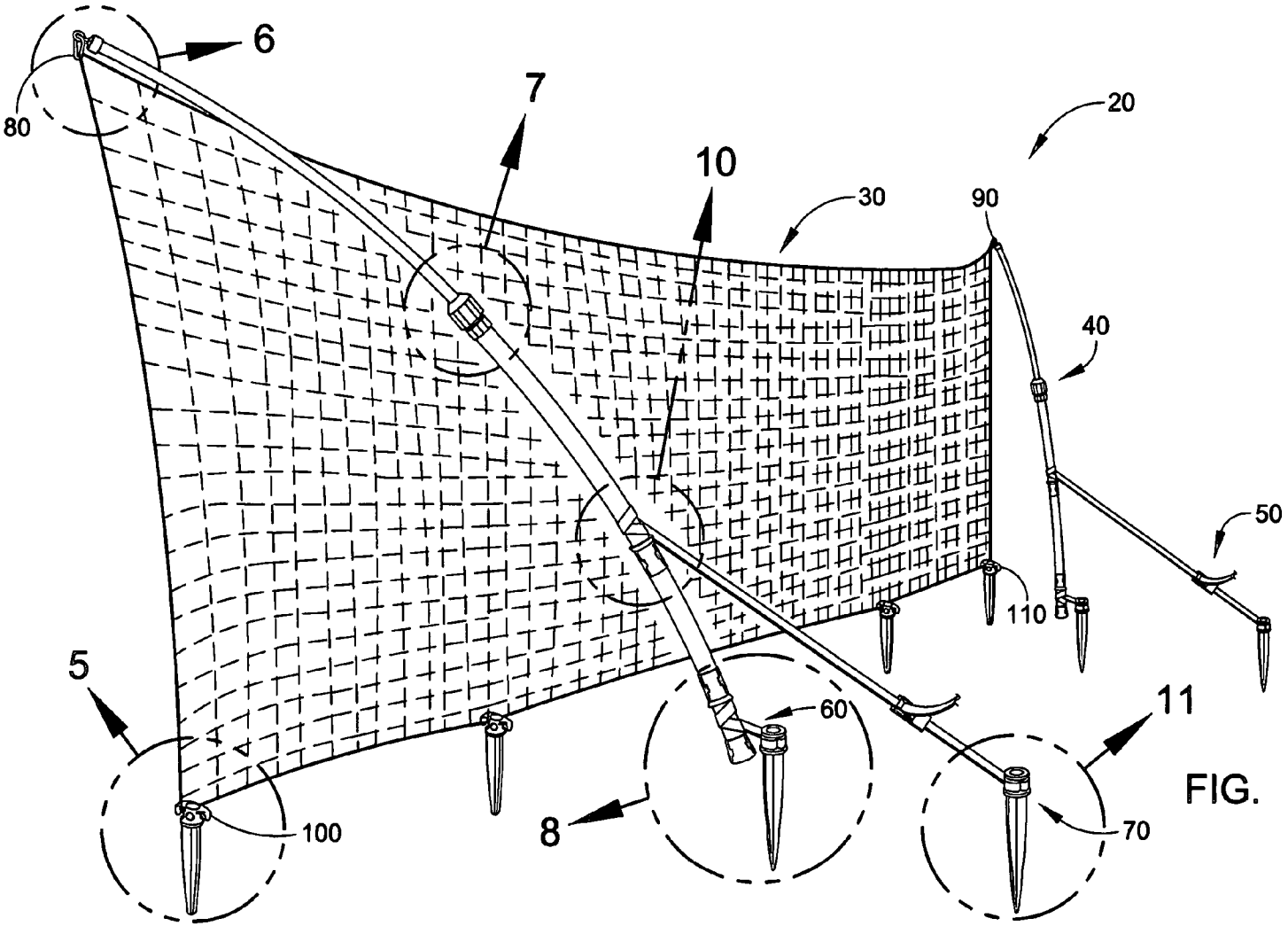
FIG. 1 is a rear perspective view of an embodiment of a frameless portable suspension system.
Figure 2:
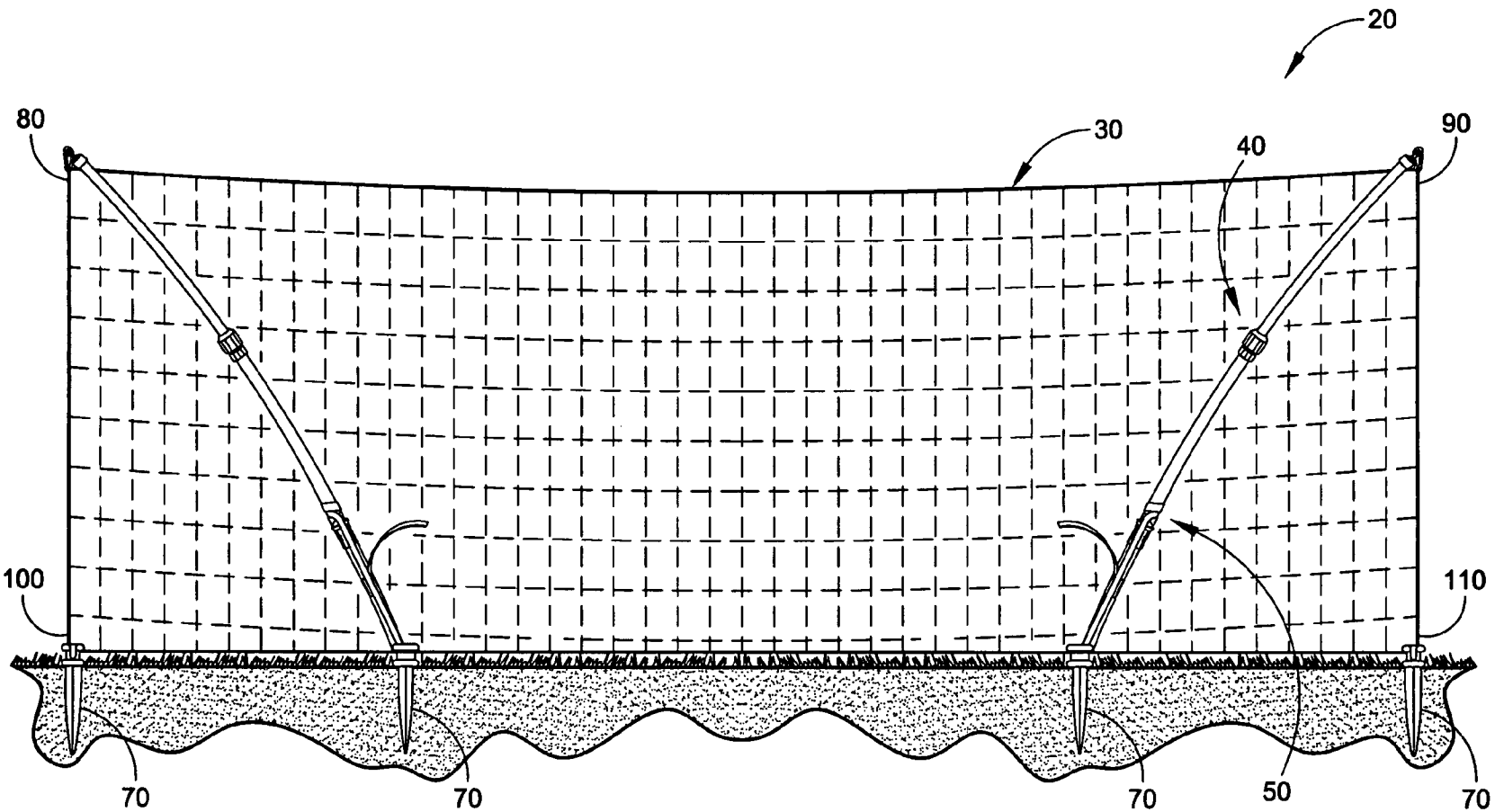
FIG. 2 is a rear elevational view of the frameless portable suspension system illustrated in FIG. 1.
Figure 3:
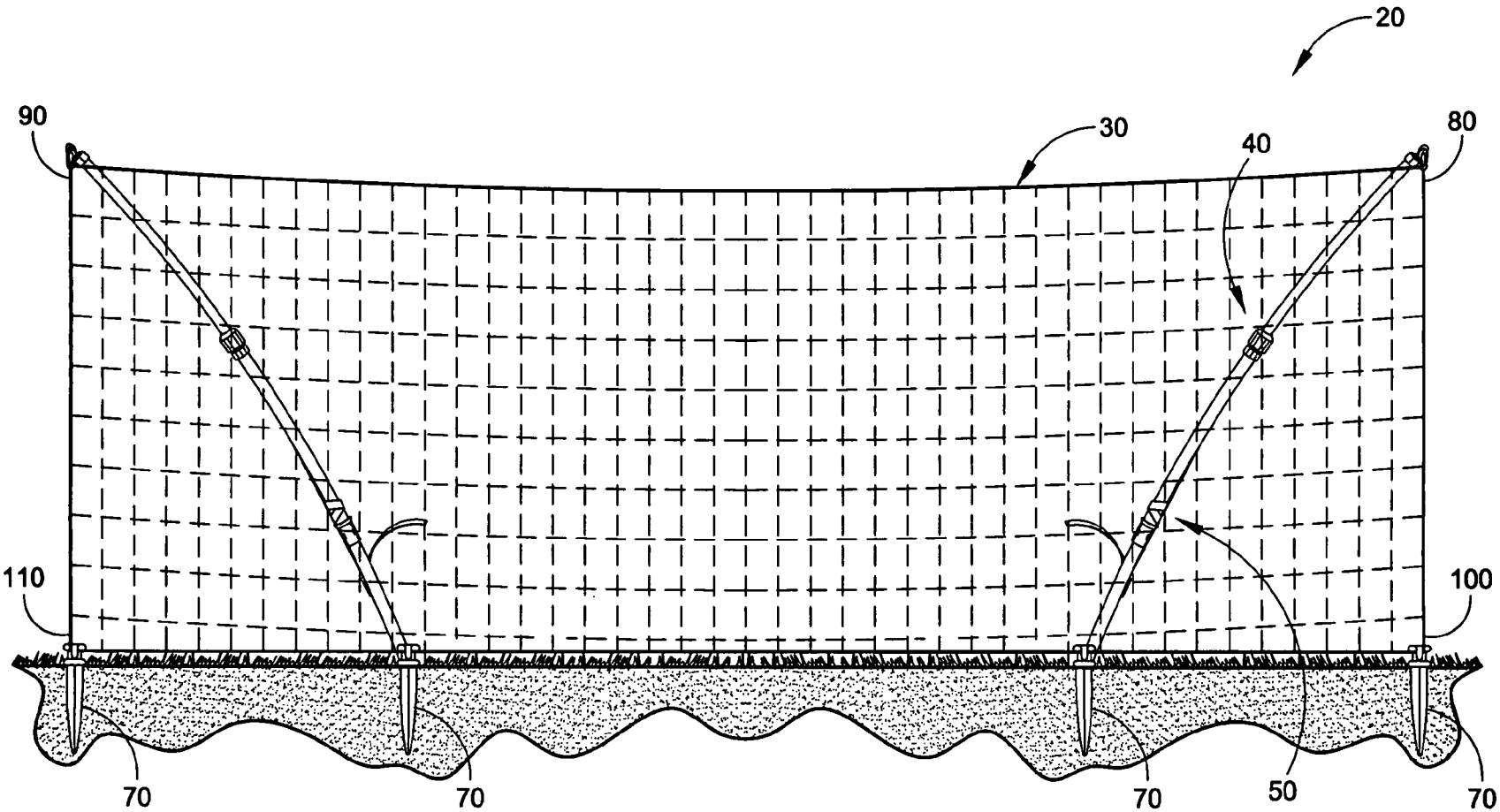
FIG. 3 is a front elevational view of the frameless portable suspension system illustrated in FIG. 1.

With reference to FIGS. 1–11, and initially FIG. 1, a frameless portable suspension system 20 constructed in accordance with an embodiment of the invention will now be described. Although the frameless portable suspension system 20 will be described in a soccer ball rebounding application, the frameless portable suspension system 20 may be used for other sports ball rebounding applications. Further, the frameless portable suspension system 20 may be used for non-rebounding applications such as, but not limited to, portable sign suspension for advertising signs (e.g., advertising new housing/rental developments, advertising political causes/candidates, or other advertising purposes).

The frameless portable suspension system 20 generally includes a tensionable two-dimensional material or net 30, a pair of telescoping pole assemblies 40, a pair of adjustable length straps 50, a pair of high strength straps 60, and multiple ground anchors 70. Each of these components will be described in turn below.

In the embodiment shown, the tensionable two-dimensional material 30 is a sport net that is tensionable in both vertical and horizontal directions to be taught yet flexible enough to withstand and repel large impact forces such as those produced by various sports balls traveling at high velocity that contact the net 30 or high velocity wind. In the embodiment shown, the net 30 is rectangular and includes the same dimensions as the goal opening in a regulation soccer goal (8 ft. in height×24 ft. in length). As used herein, "two-dimensional material" refers to materials such as flexible signs, nets stretchable into a flat configuration, and the like that when placed in tension have a configuration that is substantially in two main dimensions (i.e., substantial length and substantial width compared to thickness). The net 30 includes an upper right corner 80, an upper left corner 90, a bottom right corner 100, and a bottom left corner 110. As used herein, "frameless" means the two-dimensional material 30 does not have a frame along a substantial portion of the perimeter. In the frameless portable suspension system 20, the vertical and horizontal tension placed on the net 30 at the upper corners 80, 90 by the telescoping pole assemblies 40 maintains the net 30 in the configuration shown in FIGS. 1–3. Although the tensionable two-dimensional material 30 is shown and described as a soccer sports net, in alternative embodiments, the tensionable two-dimensional material 30 may be other tensionable materials such as, but not limited to, a flat fabric panel such as that used for an advertising sign.

Figure 7:
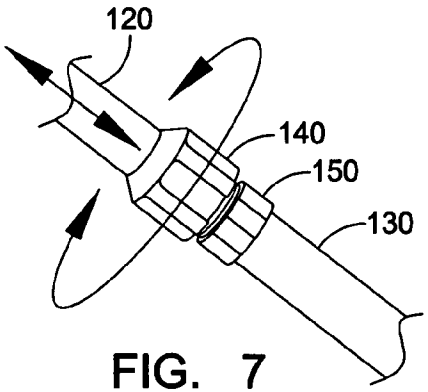
FIG. 7 is a rear perspective view of an embodiment of a telescoping connection of the telescoping pole assembly of the frameless portable suspension system taken from area 7 in FIG. 1.

With reference to FIGS. 1 and 7, the telescoping pole assembly 40 is a two-piece adjustable-length fiberglass pole and includes an 82 in., 1.00 in. outer diameter upper pole member 120 slidably received in a 82 in., 1.25 in. outer diameter lower pole member 130 for conveniently increasing and decreasing the length of the pole assembly 40. When the pole assembly 40 is set to the desired length (i.e., when the upper pole member 120 is moved to the desired position in lower pole member 130), the length of the pole assembly 40 is fixed using a plastic compression fitting including a threaded collar 140 and an externally threaded connector 150. The length of the pole assembly 40 is locked by rotating and tightening internally threaded collar 140 onto externally threaded connector 150.

Figure 6:
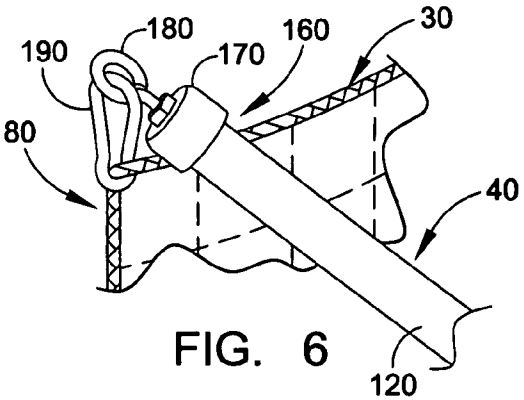
FIG. 6 is a rear perspective view of an embodiment of a top end of a telescoping pole assembly of the frameless portable suspension system taken from area 6 in FIG. 1 and shows the top end of a telescoping pole assembly connected to a top corner of the net of the frameless portable suspension system.

With reference to FIG. 6, the pole assembly 40 includes an upper end 160 with a cap 170 fixed thereto. The cap 170 carries a circular connector 180 that couples the upper end 160 to the upper corners 80, 90 through a carabiner 190. Although the connection of the upper end 160 of the pole assembly 40 is shown as including a cap 170, a circular connector 180, and a carabiner 190, in alternative embodiments, the connection may include one or more of these connector elements or one or more different connector elements.

Figure 8:
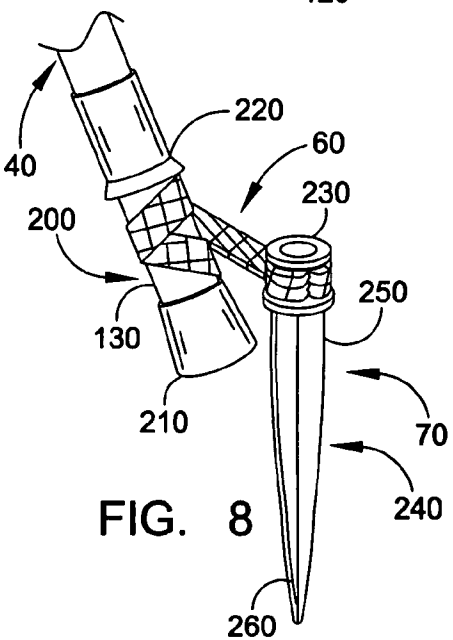
FIG. 8 is a rear perspective view of an embodiment of a bottom end of the telescoping pole assembly, a ground anchor, and a high-strength strap of the frameless portable suspension system taken from area 8 in FIG. 1.

With reference to FIG. 8, the pole assembly 40 includes a lower end 200 with a cap 210 fixed thereto. Spaced above the cap 210 is a stop 220 (with circular lip) circumferentially and longitudinally fixed to the circumference of the lower pole member 130. The high strength strap or connector 60 is made of 1 in. nylon webbing rated at 600 lb. breaking strength and is connected at one end portion to the lower pole member 130 between the stop 220 and the cap 210 and connected at an opposite end portion to a head 230 of ground anchor 70. The stop 220 prevents the strap 60 from sliding past the stop 220 on the pole assembly 40. In the embodiment shown, the ground anchor 70 is a plastic ground stake with a shaft 240. In alternative embodiments, one or more of the ground anchors 70 may have the same or a different construction/configuration from that shown in FIGS. 1–8 or may have the same or a different construction/configuration from the other ground anchors 70. For example, but not by way of limitation, the ground anchor 70 may be a ground auger. When inserted into or connected to the ground, the ground anchors 70 form anchor points with the ground. Further, in an alternative embodiment of the suspension system 20, especially where the ground is a hard surface (e.g., wood, cement, etc.), the ground anchors 70 may be replaced with permanent anchor points (e.g., in an inside environment with a hard floor, in an outside environment with a hard support surface).

Utilizing a flexible connection between the lower end 200 of the pole assembly 40 and the ground anchor 70 allows the lower end 200, when not under load, to move in a 360 degree arc, at a maximum radius equal to the distance of the high strength strap 50, relative to the ground anchor 70 and allows the pole assembly 40 to pivot freely within a possible 180 degree range at the lower end 200 relative to the ground. When under load and in response to dynamic loads, the pole assembly 40 pivots freely at the lower end 200 relative to the ground, adding to the flexibility of the frameless portable suspension system 20.

Figure 11:
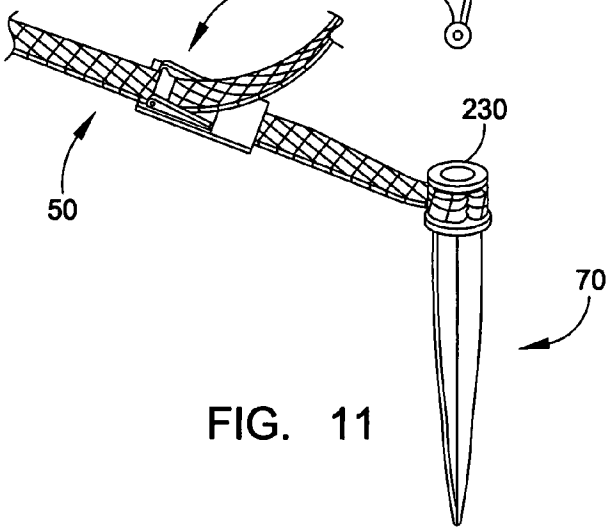
FIG. 11 is a rear perspective view of an embodiment of a ground anchor and a bottom end of the adjustable length strap of the frameless portable suspension system taken from area 11 in FIG. 1.
Figure 10:
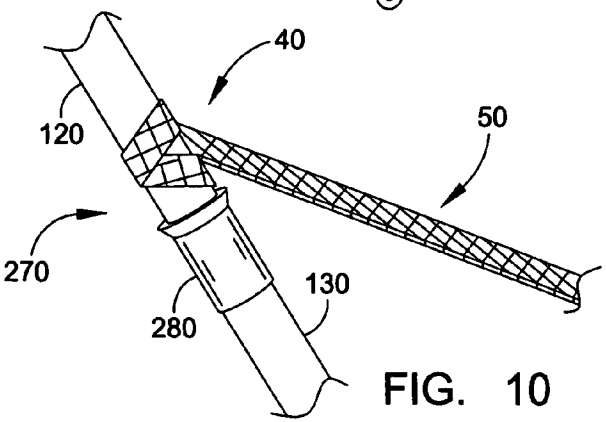
FIG. 10 is a rear perspective view of an embodiment of a connection section of the telescoping pole assembly and a top end of an adjustable length strap of the frameless portable suspension system taken from area 10 in FIG. 1.

With reference to FIGS. 1, 10, and 11, the adjustable length strap or tension connector 50 is made of 1 in. nylon webbing rated at 600 lb. breaking strength and connects below a longitudinal center 270 of the pole assembly 40 to a ground anchor 70. An upper end of the adjustable length strap 50 is connected below the longitudinal center 270 of the pole assembly 40, above a stop 280 (with circular lip), which is circumferentially and longitudinally fixed to the circumference of an upper part of the lower pole member 130. The stop 280 prevents the strap 60 from sliding past the stop 280 on the pole assembly 40. The adjustable length strap 50 is connected at an opposite lower end to the head 230 of ground anchor 70. The adjustable length strap 50 includes a strap length adjustment mechanism 290 (e.g., adjustable cam lock rated at 600 lbs.) for quickly and easily adjusting the length of the strap 50.

Figure 4:
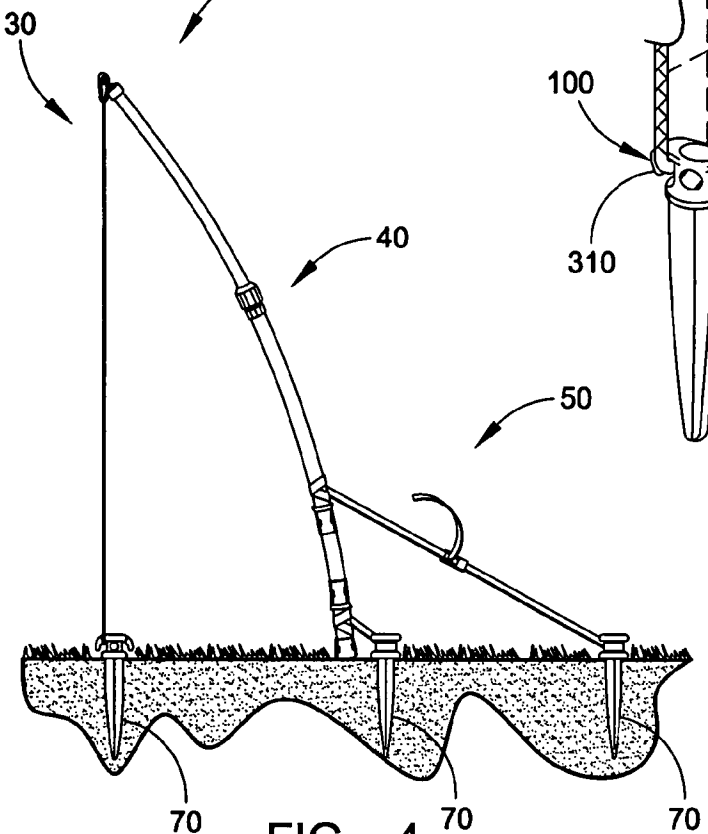
FIG. 4 is a left side elevational view of the frameless portable suspension system illustrated in FIG. 1.

The length of the strap 50 may be decreased to increase the pull rearwardly on the pole assembly 40 below the longitudinal center 270. This causes the pole assembly 40 to bow or flex upwardly and rearwardly as shown in FIG. 4, and causes the pole assembly 40 to pull the upper corner 80, 90 of the net 30 rearwardly. To increase the vertical and horizontal tension in the net 30 (increase the rebounding effect of the net 30 and the frameless portable suspension system 20) while maintaining the net 30 in a vertical plane perpendicular to the ground shown in FIG. 4, the length of the pole assembly 40 is increased and the length of the adjustable length strap 50 is decreased. Increasing the length of the pole assembly 40 causes the pole assembly 40 to push the upper corner 80, 90 of the net 30 forward; however, decreasing the length of the adjustable length strap 50 causes the pole assembly 40 to bow upwardly and rearwardly as shown in FIG. 4, and causes the pole assembly 40 to pull the upper corner 80, 90 of the net 30 rearwardly so that the net 30 is maintained in a vertical plane perpendicular to the ground. The bent pole assemblies 40 in combination with the adjustable length straps 50 stretch the net 30 vertically and horizontally. The bowed pole assemblies 40 (in combination with the adjustable length straps 50) effectively form adjustable spring mechanisms that pull vertically upward and horizontally outward at the upper corners 80, 90, and greatly enhance the rebounding properties of the stretched net 30. In an opposite manner, to decrease the vertical and horizontal tension in the net 30, the length of the strap 50 may be increased to decrease the pull rearwardly on the pole assembly 40 below the longitudinal center 270 and the length of the pole assembly 40 may be decreased. Because the pole assemblies 40 are able to pivot freely while the net 30 is under tension, a user may easily vary the tension in the net 30 in both vertical and horizontal directions while the net 30 is under load and maintaining the net 30 in a vertical plane perpendicular to the ground.

Figure 5:
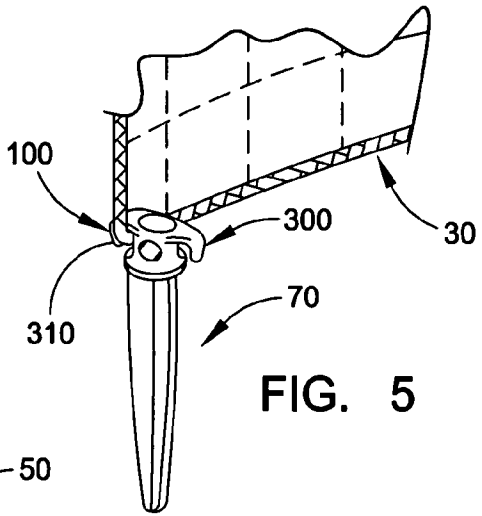
FIG. 5 is a rear perspective view of an embodiment of a ground anchor of the frameless portable suspension system taken from area 5 in FIG. 1 and shows the ground anchor connected to a bottom corner of a net of the frameless portable suspension system.

With reference to FIGS. 1 and 5, the bottom corners 100, 110 are secured to the ground at anchor points with the ground anchors 70. In the embodiment of the ground anchor 70 shown in FIG. 5, the ground anchor 70 has a different configuration than the ground anchors 70 that hold the pole assemblies 40 and adjustable length straps 50 to the ground. The ground anchor 70 illustrated in FIG. 5 includes a head 300 with a crook 310 that catches the corner 100, 110 of the net 30 for securing the corner 100, 110 to the ground at anchor points. As shown in FIGS. 1–3 and 9, additional ground anchors 70 similar to that shown in FIG. 5 may be utilized at various positions along the bottom of the net 30 to secure the bottom of the net 30 to the ground at anchor points.

Figure 9:
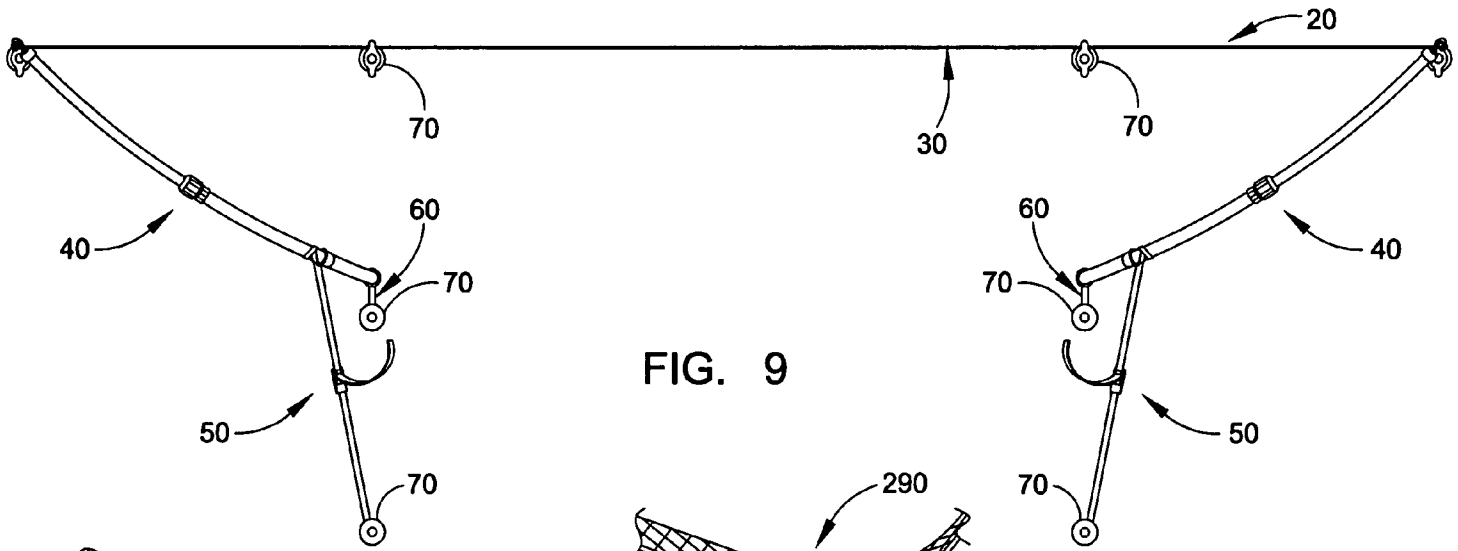
FIG. 9 is a top plan view of the frameless portable suspension system illustrated in FIG. 1.

FIG. 9 illustrates the frameless portable suspension system 20 in an assembled configuration. In this configuration, the net 30 is in a vertical plane perpendicular to the ground, the lower ends 200 of the telescoping pole assemblies 40 extend inwardly and rearwardly relative to the upper corners 80, 90, and the adjustable length straps 50 extend rearwardly and inwardly from below the longitudinal center 270 of the pole assemblies 40 to the ground anchors 70. The inner anchors 70 are generally aligned and a line drawn therethrough is generally perpendicular to the vertical plane of the net 30.

An exemplary method of assembling the frameless portable suspension system 20 will now be described. To assemble the frameless portable suspension system 20, the net 30 is first unrolled/unraveled and spread out in the desired location (i.e., the net 30 is positioned). Next, the bottom corners 100, 110 of the net 30 are secured to the ground with ground anchors 70 (See FIG. 5). The back ground anchors 70 are then installed behind the net as shown in FIG. 9. The upper ends 160 of the telescoping pole assemblies 40 are connected to the upper corners 90, 100 of the net 30 (See FIG. 6). The lower ends 200 of the telescoping pole assemblies 40 are then connected to the ground anchors 70 via the high strength straps 60 (See FIG. 8). Next, the right pole assembly 40 (when looking at the front of the net 30 as in FIG. 3) is pre-tensioned (i.e., the right pole assembly 40 is adjusted to a desired initial length). Then, the left pole assembly 40 is pre-tensioned and the adjustable length strap 50 is pre-tensioned (strap 50 is adjusted to desired initial length). The right pole assembly 40 is then final tensioned (i.e., the right pole assembly 40 is fine-tuned to the final desired length that provides the desired amount of rebound in the net 30) and the right adjustable length strap 50 is tightened/shortened to a length that causes the net 30 to be within a vertical plane perpendicular to the ground as shown in FIG. 9. The left pole assembly 40 is then final tensioned or fine-tuned to the final desired length that provides the desired amount of rebound in the net 30 and the left adjustable length strap 50 is tightened/shortened to a length that causes the net 30 to be within a vertical plane perpendicular to the ground as shown in FIG. 9. The bottom of the net 30 between the bottom corners 100, 110 is then secured to the ground with the intermediate ground anchors 70. The frameless portable suspension system 20 is then ready for use.

An exemplary method of using the frameless portable suspension system 20 as a sports ball rebounder, and, in particular, a soccer ball rebounder, will now be described. A user faces the soccer net 30 of the frameless portable suspension system 20 in the orientation shown in FIG. 3. The user kicks a soccer ball at the net 30. The soccer ball hits the net 30, causing the net 30 to move rearward, especially the area of the net 30 where impact occurs. Because the net 30 is in a high state of tension (in both the vertical and horizontal directions) by the pole assemblies 40 and adjustable length straps 50, and the pole assemblies 40 effectively function as spring mechanisms, a high percentage of the energy absorbed by the frameless portable suspension system 20 when the soccer ball hits the frameless portable suspension system 20, is returned to the soccer ball and the soccer ball is rebounded back towards the user. It should be noted, not only is the frameless portable suspension system 20 ideal for use as a soccer rebounder practice device 20, but because the net 30 is the same dimension as the opening of a regulation soccer goal, the soccer rebounder practice device 20 also ideally functions as a portable soccer goal, which can be set up on any field.

Because the frameless portable suspension system 20 lacks a perimeter frame and only uses two telescoping pole assembly 40, one net 30, two adjustable length straps 50, two high strength straps 60, and anchors 70, the frameless portable suspension system 20 is very light-weight, very easy to assemble, and inexpensive to manufacture (especially in view of the relatively short pole length of the pole assemblies 40 compared to prior art nets/rebounders where perimeter pole frames or other pole-intensive assemblies were used). The frameless portable suspension system 20 also allows a user to easily vary the tension in the net 30 in both vertical and horizontal directions while the net 30 is under load and keeps the net 30 in a vertical plane perpendicular to the ground. The frameless portable suspension system 20 absorbs the blow of large forces such as those produced by a high-velocity soccer ball or a player accidentally running into the net 30 while also exhibiting exceptional rebounding properties.

Different-sized nets 30 may be used with the same frameless portable suspension system 20. For example, but not by way of limitation, a user may replace the net 30 with a different-size net 30 (e.g., for another size goal such as a smaller youth dimension) without having to change out the remainder of the frameless portable suspension system 20. Also, the surface and contour of the net 30 may be shaped by changing the position of where the ground anchors 70 for the central portion of the net 30 secure the central portion of the net 30 to the ground. For example, by placing these central ground anchors 70 aft of the line formed by the corners 100, 110, the shape of the net 30 will become partly concave so that rebounds from the sides of the net 30 are directed towards the center of the playing area in front of the net 30.

Another advantage of the frameless portable suspension system 20 is the large amount of vertical and horizontal tension that the pole assemblies 40 (in combination with the adjustable length straps 50) are able to put on the net 30. This is a main reason why the frameless portable suspension system 20 functions so well as a sports ball rebounder and is able to return such a large amount of the energy imparted on the frameless portable suspension system 20 with the sports ball. A series of vertical and horizontal tension tests were conducted near the upper corners 80, 90 of the net 30. At a pole assembly length of 139.75 in., the vertical tension near the upper corners 80, 90 was 8.5 lbs. to move this portion of the net 30 down 1 in. At a pole assembly length of 142.75 in., the vertical tension near the upper corners 80, 90 was 14.5 lbs. to move this portion of the net 30 down 1 in. At a pole assembly length of 145.75 in., the vertical tension near the upper corners 80, 90 was 16.5 lbs. to move this portion of the net 30 down 1 in. At a pole assembly length of 148.75 in., the vertical tension near the upper corners 80, 90 was 18.0 lbs. to move this portion of the net 30 down 1 in. At a pole assembly length of 142.75 in., the horizontal tension near the top center of the net 30 was 10.5 lbs. At a pole assembly length of 145.75 in., the horizontal tension near the top center of the net 30 was 11.5 lbs. At a pole assembly length of 148.75 in., the horizontal tension near the top center of the net 30 was 12.5 lbs.

It will be readily apparent to those skilled in the art that still further changes and modifications in the actual concepts described herein can readily be made without departing from the spirit and scope of the invention as defined by the following claims.

What is claimed is:

1. A frameless portable suspension system, comprising:

a tensional two-dimensional material having a frameless perimeter, opposite upper corners, and a bottom secured to ground, the tensional two-dimensional material located in a vertical plane perpendicular to the ground;

a pair of adjustable spring mechanisms coupled to the upper corners and providing the upper corners in tension in an upward vertical direction and a outward horizontal direction, the adjustable spring mechanisms disposed rearward of the tensional two-dimensional material and including lower ends adjacent the ground that are freely pivotal relative to the ground, the lower ends forming vertices of angles defined by the adjustable spring mechanisms and the ground, and the angles freely changeable with free pivotal movement of the lower ends of the adjustable spring mechanisms;

wherein the tension in the tensional two-dimensional material is adjustable with the adjustable spring mechanisms while the tensional two-dimensional material is under tension and the tensional two-dimensional material is positionable in a vertical plane perpendicular to the ground upon adjustment of the tension in the tensional two-dimensional material with the adjustable spring mechanism.

2. The frameless portable suspension system of claim 1, wherein the frameless portable suspension system is a sportsball rebounder and the tensional two-dimensional material is a sports net.

3. The frameless portable suspension system of claim 2, wherein the sportsball rebounder is a soccer ball rebounder and the tensional two-dimensional material is a 8 ft. in height×24 ft. in length sports net.

4. The frameless portable suspension system of claim 1, wherein the pair of adjustable spring mechanisms include a pair of adjustable length resilient poles coupled to the upper corners of the tensional two-dimensional material and including a longitudinal center, and the frameless portable suspension system further includes a pair of tension connectors including ends connected to the pair of adjustable length resilient poles near the low longitudinal center to provide flex in the pair of adjustable length resilient poles and opposite ends secured to the ground.

5. The frameless portable suspension system of claim 4, wherein the pair of adjustable length resilient poles are telescoping pole assemblies.

6. The frameless portable suspension system of claim 4, further including high-strength connectors connecting the lower ends of the pair of adjustable length resilient poles to the ground at anchor points, the lower ends contacting the ground at locations other than the anchor points.

7. The frameless portable suspension system of claim 4, wherein the pair of tension connectors are adjustable length straps.

8. The frameless portable suspension system of claim 1, wherein the tension in the upward vertical direction is at least 8.5 lbs. and the tension in the outward horizontal direction is at least 10.5 lbs.

9. The frameless portable suspension system of claim 1, wherein the frameless portable suspension system is an advertising sign suspension system and the tensional two-dimensional material is an advertising sign.

10. A frameless portable suspension system, comprising:

a tensional two-dimensional material having a frameless perimeter, opposite upper corners, and a bottom secured to ground, the tensional two-dimensional material located in a vertical plane perpendicular to the ground;

a pair of adjustable length resilient poles coupled to the upper corners of the tensional two-dimensional material and including a longitudinal center, the poles disposed rearward of the tensional two-dimensional material and including lower ends adjacent the ground that are freely pivotal relative to the ground, the lower ends forming vertices of angles defined by the poles and the ground, and the angles freely changeable with free pivotal movement of the lower ends of the adjustable spring mechanisms;

a pair of tension connectors including ends connected to the pair of adjustable length resilient poles below the longitudinal center to provide flex in the pair of adjustable length resilient poles and opposite ends secured to the ground.

11. A frameless portable suspension system, comprising:

a tensional two-dimensional material having a frameless perimeter, opposite upper corners, and a bottom secured to ground, the tensional two-dimensional material located in a vertical plane perpendicular to the ground;

a pair of adjustable length resilient poles disposed rearward of the tensional two-dimensional material and including upper ends coupled to the upper corner of the tensional two-dimensional material and lower ends adjacent the ground that are freely pivotal relative to the ground, the lower ends forming vertices of angles defined by the poles and the ground, and the angles freely changeable with free pivotal movement of the lower ends of the adjustable spring mechanisms, wherein the pair of adjustable length resilient poles provide the upper corners in tension in an upward vertical direction and a outward horizontal direction.

12. The frameless portable suspension system of claim 11, further including a pair of tension connectors including ends connected to the pair of adjustable length resilient poles below the longitudinal center to provide flex in the pair of adjustable length resilient poles and opposite ends secured to the ground.

13. The frameless portable suspension system of claim 12, wherein the pair of adjustable length resilient poles are telescoping pole assemblies.

14. The frameless portable suspension system of claim 12, wherein the pair of tension connectors are adjustable length straps.

15. The frameless portable suspension system of claim 10, wherein the pair of adjustable length resilient poles are telescoping pole assemblies.

16. The frameless portable suspension system of claim 10, wherein the pair of tension connectors are adjustable length straps.

* * * * *